US007604674B2

(12) United States Patent
Han et al.

(10) Patent No.: US 7,604,674 B2
(45) Date of Patent: Oct. 20, 2009

(54) DUST SEPARATING APPARATUS

(75) Inventors: Jung-gyun Han, Busan (KR); Jang-keun Oh, Gwangju (KR); Min-ha Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 524 days.

(21) Appl. No.: 11/332,070

(22) Filed: Jan. 13, 2006

(65) Prior Publication Data

US 2007/0011997 A1 Jan. 18, 2007

Related U.S. Application Data

(60) Provisional application No. 60/698,389, filed on Jul. 12, 2005.

(30) Foreign Application Priority Data

Aug. 9, 2005 (KR) ..... 10-2005-0072800

(51) Int. Cl.
*B01D 50/00* (2006.01)

(52) U.S. Cl. ..... 55/337; 55/345; 55/346; 55/349; 55/DIG. 3; 15/353; 15/347

(58) Field of Classification Search ..... 55/320, 55/323, 337, 345, 346, 349, DIG. 3; 15/347, 15/353

See application file for complete search history.

(56) References Cited

U.S. PATENT DOCUMENTS

2006/0037479 A1* 2/2006 Song et al. ..... 96/385

FOREIGN PATENT DOCUMENTS

DE 20306405 8/2003

(Continued)

OTHER PUBLICATIONS

Machine translation of JPO of 2004-135700, 27 pages.*

(Continued)

*Primary Examiner*—Duane Smith
*Assistant Examiner*—Dung Bui
(74) *Attorney, Agent, or Firm*—Ohlandt, Greeley, Ruggiero & Perle, L.L.P.

(57) ABSTRACT

A dust separating apparatus for a vacuum cleaner includes a dust collection casing with an air inlet at a lower portion, a mesh filter formed on a bottom surface of the dust collection casing to firstly filter the contaminant from the drawn-in air, a plurality of cyclones formed in parallel in the dust collection casing to secondly filter the contaminant in the air drawn in via the air inlet, and a dust collection part formed at one side of the plurality of cyclones to collect the contaminant separated from the air. The air flowed in the air inlet formed at the lower portion of the dust collection casing is sequentially discharged via the mesh filter formed on the bottom surface of the dust collection casing and the plurality of cyclones.

9 Claims, 4 Drawing Sheets

FOREIGN PATENT DOCUMENTS

| | | | | |
|---|---|---|---|---|
| EP | 1488729 | A2 | | 12/2004 |
| GB | 2406066 | | | 3/2005 |
| GB | 2406066 | A | * | 3/2005 |
| JP | 46-31072 | | | 9/1971 |
| JP | 57-149852 | | | 9/1982 |
| JP | 58-68249 | | | 5/1983 |
| JP | 2004-135700 | | | 5/2004 |
| JP | 2004135700 | A | * | 5/2004 |

OTHER PUBLICATIONS

Office Action dated Apr. 26, 2007 from corresponding Russian Patent Application No. 2006104732.
Office Action dated Nov. 18, 2008 corresponding to Japanese Patent Application No. 2006-008938.

* cited by examiner

DUST SEPARATING APPARATUS

CROSS-REFERENCE TO RELATED APPLICATIONS

This application claims benefit under 35 U.S.C. § 119 (a) of Korean Patent Application No. 2005-72800 filed on Aug. 9, 2005, and claims benefit under 35 U.S.C. § 119 (e) of U.S. Provisional application No. 60/698,389 filed on Jul. 12, 2005, the entire contents of both of which are incorporated herein by reference.

BACKGROUND OF THE INVENTION

1. Field of the Invention

The present invention relates to a dust separating apparatus for a vacuum cleaner, which draws in contaminant-laden air from a cleaning surface, separates and collects contaminant from the air, and discharge cleaned air.

2. Description of the Related Art

Generally, a vacuum cleaner drives a motor to generate a suction force and draws in dust and contaminant-laden air via a suction nozzle from a cleaning surface. The vacuum cleaner uses a dust separating apparatus of a cleaner body to separate and collect dust and contaminant (hereafter "contaminant") from drawn-in air and discharges the air removed of contaminant to the outside.

There are various kinds of dust separating apparatuses. Recently, a cyclone-type dust separating apparatus, which provides convenience to use and can be used semi-permanently, is widely used, compared to a dust separating apparatus employing a disposable dust bag or dust filter. FIG. 1 is a perspective view of a canister type vacuum cleaner employing a cyclone-type dust separating apparatus.

Referring to FIG. 1, a vacuum cleaner 10 generally comprises a cleaner body 11 having a motor driving chamber 12 with a motor (not shown) and a mounting chamber 13 in which a dust separating apparatus 30 is mounted, a suction nozzle 21, an extension hose 22, and a flexible hose 23. The vacuum cleaner 10 drives the motor (not shown) to generate a suction force, and draws contaminant-laden air from a cleaning surface through the suction nozzle 21, the extension hose 22, and the flexible hose 23 into the cleaner body 11. The vacuum cleaner 10 uses the dust separating apparatus 30 to separate and collect contaminant from drawn-in air and discharges the air removed of contaminant via the motor driving chamber 12 to the outside.

The cyclone-type dust separating apparatus 30 forms a rotating stream so that contaminant can be separated from drawn-in air by a centrifugal force on the rotating stream. The cyclone-type dust separating apparatus 30 generally has a cylindrical cyclone body 31 to form a rotating stream, an air inlet 33 and an air outlet (not shown) at an upper portion of the cyclone body 31. The air inlet 33 is fluidly communicated via an inlet port 14 with the flexible hose 23, and the air outlet (not shown) is fluidly communicated via an outlet port 15 with the motor driving chamber 12.

The cyclone-type dust separating apparatus 30 has a deteriorated collection capability of contaminant due to the structure. Accordingly, a dual cyclone dust separating apparatus has been introduced in which two cyclone bodies are in line arranged one on the other to improve the collection capability of contaminant. The dual cyclone dust separating apparatus can increase the collection capability of contaminant; however, the dual cyclone dust separating apparatus has a lengthened air path so that the pressure is greatly lost and the suction force of the motor apparently decreases.

A contaminant receptacle 32 for collecting the contaminant separated from drawn-in air in the cyclone body 31 is engaged with a bottom portion of the cyclone body 31, and is also cylindrical to correspond to the cyclone body 31. In other words, the conventional dust separating apparatus 30 is generally cylindrical. Accordingly, as shown in FIG. 2, a dead space S is generated in the mounting chamber 13 except for an area where the dust separating apparatus 30 is mounted. In the cleaner body 11, generally, the motor driving chamber 12 is substantially rectangular and the mounting chamber 13 engaged with the motor driving chamber 12 is substantially semicircular. Due to the cylindrical dust separating apparatus 30, a structural problem is occurred which can not avoid a dead space generated in the mounting chamber 13. Additionally, the contaminant receptacle 32 can not be manufactured over a certain height due to the limited height of the dust separating apparatus 30 so that the capacity of dust collection system also has limitation.

SUMMARY OF THE INVENTION

The present invention has been conceived to solve the above-mentioned problems occurring in the prior art, and an aspect of the present invention is to provide a dust separating apparatus which improves an efficiency of dust collection and has a large suction force.

Another aspect of the present invention is to provide a dust separating apparatus, which can increase a capacity of dust collection in a limited size.

In order to achieve the above aspects, there is provided a dust separating apparatus detachably engaged with a mounting chamber of a vacuum cleaner body to separate and collect a contaminant from an air drawn in from a cleaning surface by a suction force of a motor. The dust separating apparatus comprises a dust collection casing with an air inlet at a lower portion, a mesh filter formed on a bottom surface of the dust collection casing to firstly filter the contaminant from the drawn-in air, a plurality of cyclones formed in parallel in the dust collection casing to secondly filter the contaminant in the air drawn in via the air inlet, and a dust collection part formed at one side of the plurality of cyclones to collect the contaminant separated from the air. The air flowed in the air inlet formed at the lower portion of the dust collection casing is sequentially discharged via the mesh filter and the plurality of cyclones.

The plurality of cyclones comprise a primary and a secondary cyclones, and the mesh filter may be formed between the primary and the secondary cyclones.

The dust collection casing may be substantially semicircular including a linear part and an arc part to correspond to the mounting chamber.

Each of the primary and the secondary cyclones comprises a cyclone body, the cyclone body comprising a cyclone inlet formed at a lower portion of the cyclone body to correspond to the air inlet, a cyclone chamber centrifugally separating the contaminant from the air drawn in via the cyclone inlet, a dust discharge opening formed at an upper portion of the cyclone body to discharge contaminant from the air, and a cyclone outlet formed on a bottom surface of the cyclone body, and a part of each of the primary and the secondary cyclone bodies may be formed by the arc part of the dust collection casing.

The dust collection part may be mostly surrounded by the linear part of the dust collection part and the primary and the secondary cyclone bodies.

The apparatus may further comprise a cover detachably engaged with a top portion of the dust collection casing, and the cover may comprises a discharge guide pipe guiding the air to the cyclone outlet as the air ascends to separate from the contaminant in the cyclone chamber.

BRIEF DESCRIPTION OF THE DRAWINGS

The above and other aspects, features and advantages of the present invention will be more apparent from the following detailed description taken with reference to the accompanying drawings, in which.

DETAILED DESCRIPTION OF THE EXEMPLARY EMBODIMENTS

Figure 1:
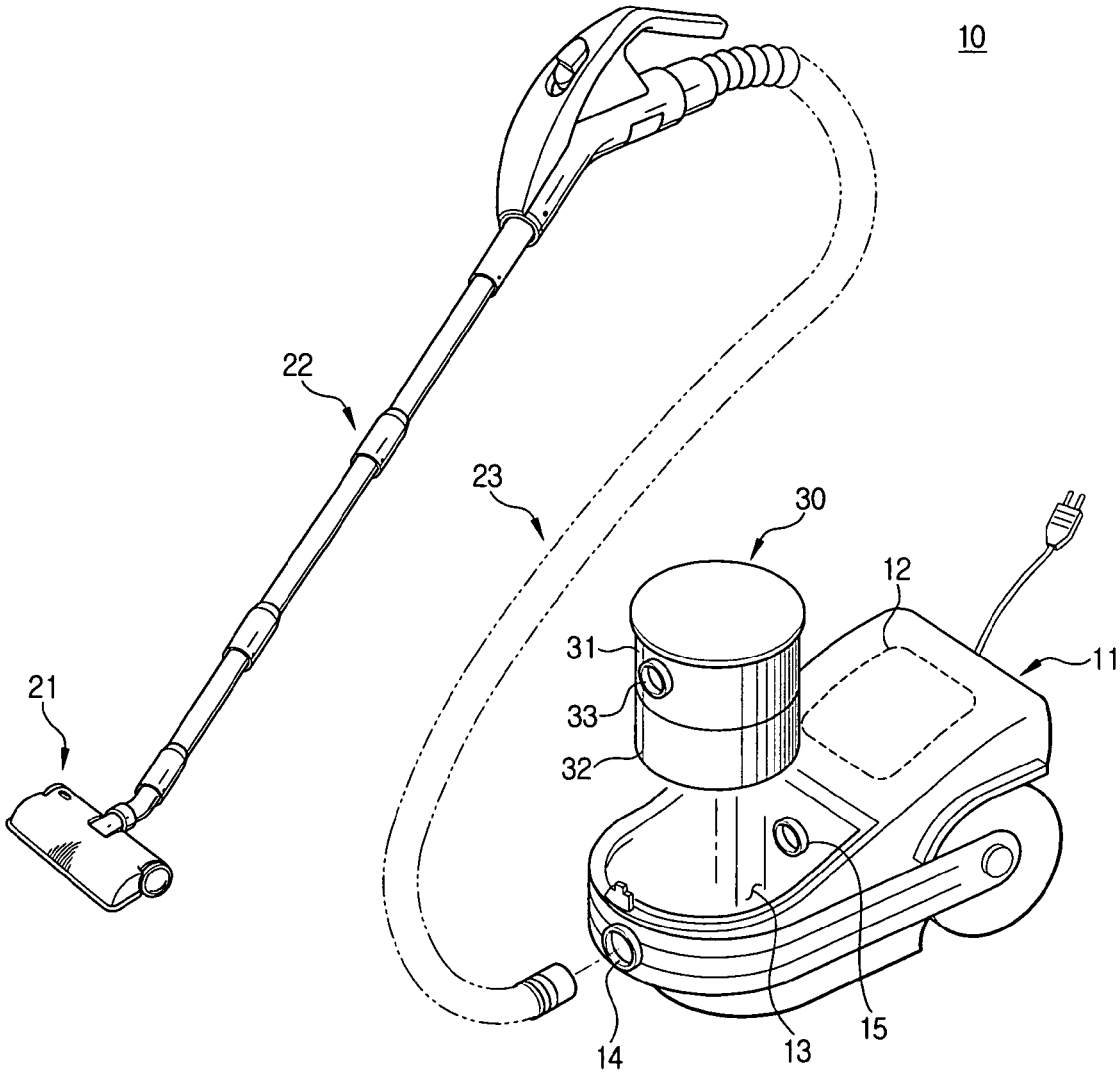
FIG. 1 (PRIOR ART)
FIG. 1 is a perspective view of a prior art vacuum cleaner employing a general dust separating apparatus.

Exemplary embodiments of the present invention will be described in detail with reference to the annexed drawings. In the drawings, the same elements are denoted by the same reference numerals throughout the drawings. In the following description, detailed descriptions of known functions and configurations incorporated herein have been omitted for conciseness and clarity.

Figure 3:
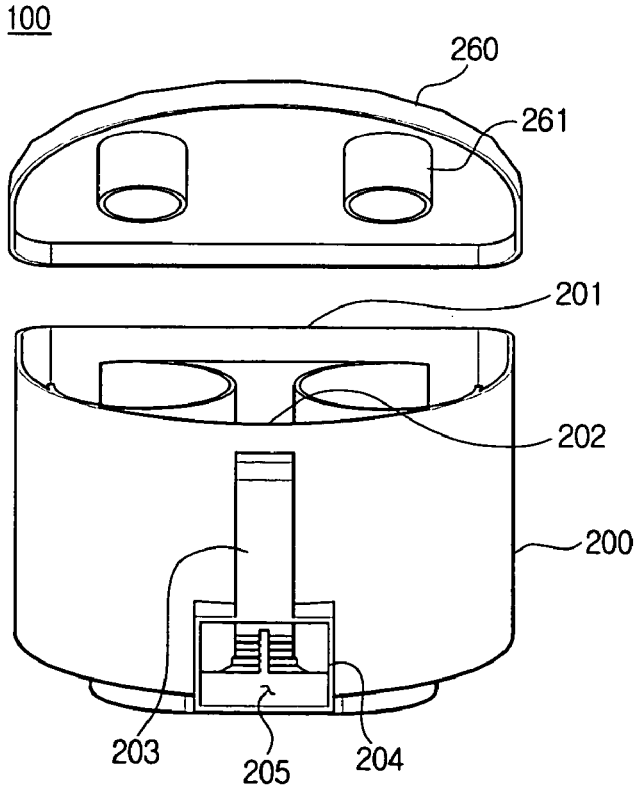
FIG. 3 is an exploded perspective view of a dust separating apparatus according to an exemplary embodiment of the present invention.

Referring to FIG. 3, a dust separating apparatus 100 comprises a dust collection casing 200, a cover 260 detachably engaged with a top portion of the dust collection casing 200. For convenience of explanation, FIG. 3 depicts the dust separating apparatus with a front portion of the cover 260 lifted by a certain degree.

The dust collection casing 200 is substantially semicircular to correspond to the mounting chamber 13 (refer to FIG. 1). The dust collection casing 200 comprises a linear part 201 with a certain length, and an arc part 202 connected to both ends of the linear part 201. A handle 203 is formed in a center at a front portion of the arc part 202 for holding of a user. An air inlet 205 is formed at a lower portion 209 of the front of the arc part 202 to fluidly communicate with an air inlet pipe 204. The air inlet pipe 204 is fluidly communicated with the inlet port 14 (refer to FIG. 1) of the vacuum cleaner to allow contaminant-laden air to flow through the air inlet pipe 204 and the air inlet 205 into the dust collection casing 200 as air is drawn in via a suction nozzle 21 (refer to FIG. 1) from the cleaning surface. In some embodiments of the present disclosure, the air inlet pipe 204 may be omitted, and the air inlet 205 may be fluidly communicated directly with the inlet port 14.

Figure 4:
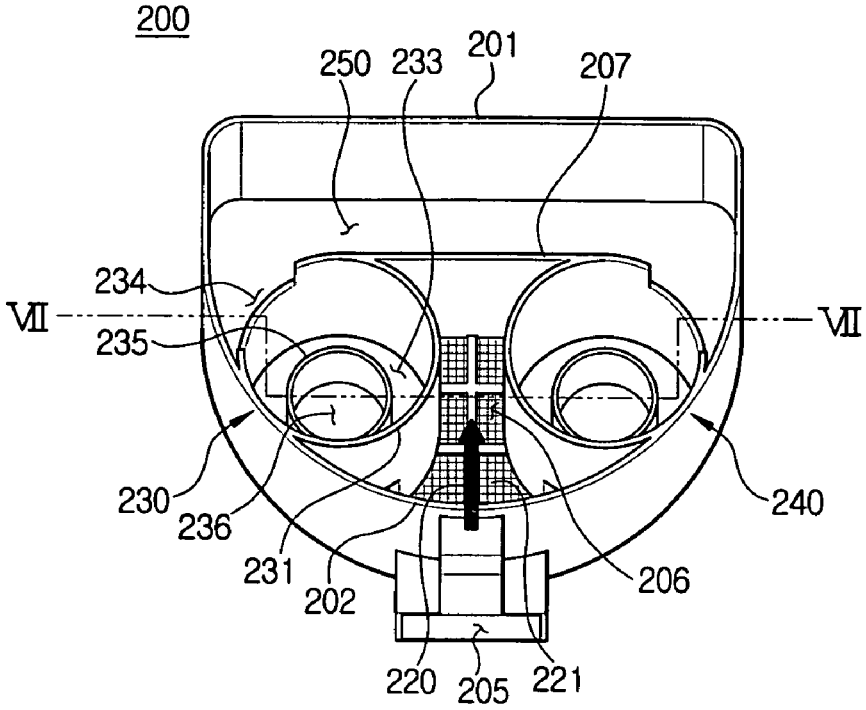
FIG. 4 is a perspective view of a dust collection casing of a dust separating apparatus of FIG. 3.
Figure 5:
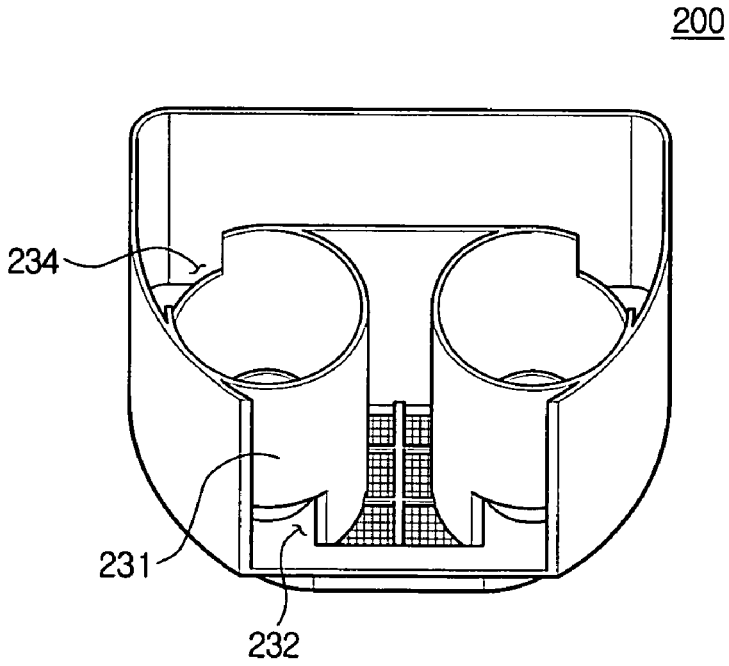
FIG. 5 is a perspective view of the dust collection casing of FIG. 4 from which a front portion is partially cut away.
Figure 6:
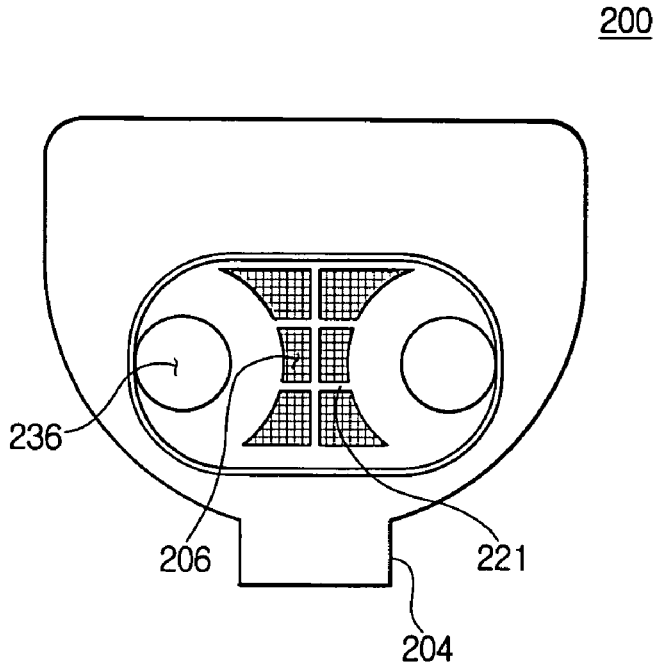
FIG. 6 is a bottom view of the dust collection casing of FIG. 4.

Referring to FIGS. 4 through 6, the dust collection casing 200 comprises a guide air path 220 with a mesh filter 221, a primary cyclone 230, and a secondary cyclone 240, and a dust collection part 250.

The guide air path 220 guides the air and contaminant to discharge to the motor driving chamber 12 (refer to FIG. 1) of the vacuum cleaner as the air and contaminant are drawn in via the air inlet 205, and of which an end is fluidly communicated with the air inlet 205 and of which the other end is fluidly communicated with an air discharge opening 206. The air inlet 205 is fluidly communicated with the suction nozzle 21, and the air discharge opening 206 is fluidly communicated with the motor driving chamber 12.

The air discharge opening 206 is formed on a bottom surface 208 of the dust collection casing 200. A mesh filter 221 is formed in the air discharge opening 206 to filter contaminant from drawn in air and pass only cleaned air to the motor driving chamber 12. The mesh filter 221 is a member in form of a fine net, which does not allow air to pass therethrough if blocked by contaminant. A blocking member 207 prevents a part of air from flowing in the dust collection part 250 as air flows in the guide air path 220.

Various structures of the guide air path 220 are possible so that air that flows in the air inlet 205 can directly pass the mesh filter 221 to discharge to the motor driving chamber 12 instead of passing the primary and secondary cyclones 230, 240. However, as shown, the guide air path 220 may be preferably formed between the primary and secondary cyclones 230, 240 and in a shortest path between the air inlet 205 and the air discharge opening 206 without changing its flow path.

The primary and secondary cyclones 230, 240 are formed at opposite sides of the guide air path 220 to separate contaminant from air drawn in via the air inlet 205 and discharge the air removed of the contaminant to the motor driving chamber 12. The primary and secondary cyclones 230, 240 are in parallel arranged in the dust collection casing 200. The primary and secondary cyclones 230, 240, preferably, have the same structures and functions, and therefore, only the primary cyclone 230 will be explained herein.

The primary cyclone 230 comprises a cyclone inlet 232, a cyclone body 231 with a cyclone chamber 233 and a dust discharge opening 234, and an air discharge pipe 235.

The cyclone body 231 is cylindrical for air and contaminant to form a rotating stream, and has substantially the same height as the dust collection casing 200. A part of the cyclone body 231 is formed by the arc part 202 of the dust collection casing 200. The cyclone inlet 232 is formed at a lower portion 237 of the cyclone body 231 to substantially face the air inlet 205. An upper portion 238 of the cyclone body 231 is partially cut to form the dust discharge opening 234 through which contaminant separated from drawn-in air by the cyclone chamber 233 is discharged.

The air discharge pipe 235 is formed in a central portion in the cyclone body 231 to protrude from the bottom surface 208 of the dust collection casing 200 by a certain length. The air discharge pipe 235 has a cyclone outlet 236 which discharges air removed of contaminant by the cyclone chamber 233 to the motor driving chamber 12. Accordingly, as shown in FIG. 6, the air discharge opening 206 with the mesh filter 221 and the cyclone outlet 236 are formed on the bottom surface 208 of the dust collection casing 200, and the air discharge opening 206 and the cyclone outlet 236 are fluidly communicated with the motor driving chamber 12. The cyclone outlet 236 may be formed at the cyclone body 231. In other words, the dust separating apparatus 100 according to an embodiment of the present invention has a structure of suction and discharge proximate to the bottom surface 208.

Although not shown, a filter member such as a grille may be formed at a top portion of the air discharge pipe 235 to filter contaminant from drawn-in air.

As described above, the suction force of the motor (not shown) is simultaneously applied for the guide air path 220, the primary and secondary cyclones 230, 240 so that the suction force can be improved. The mesh filter 221 in the guide air path 220, and the primary and the secondary cyclones 230, 240 sequentially operate so that the efficiency of dust collection can increase. Additionally, the primary and the secondary cyclones 230, 240 are in parallel arranged so that the pressure loss can be decreased as compared to prior art arrangements have two cyclones that are arranged in line. In other words, according to the dust separating apparatus 100 consistent with embodiments of the present invention, the efficiency of dust collection increases, the pressure loss decreases, and the suction force increases.

The dust collection part 252 is formed at one side of the primary and the secondary cyclones 230, 240 to collect dust discharged from the dust discharge opening 234. The dust collection part 250 is mostly surrounded by the linear part 201 of the dust collection casing 200 and the cyclone bodies 231, 241 of the primary and the secondary cyclones 230, 240.

Figure 2:
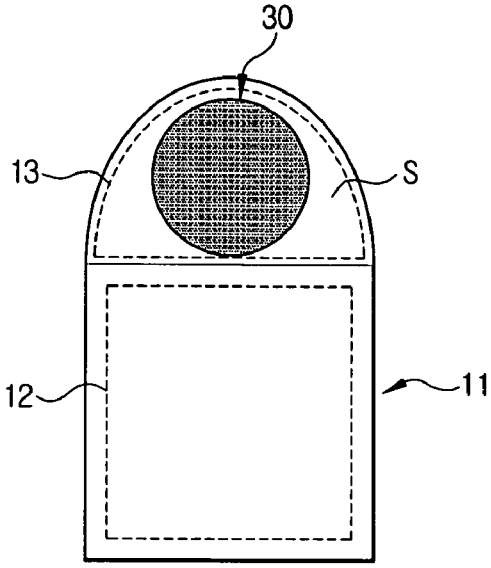
FIG. 2 (PRIOR ART)
FIG. 2 is a schematic plan view of the vacuum cleaner body of FIG. 1.

As described above, the dust collection part 250 is formed in the rest space except for the primary and the secondary cyclones 230, 240 in the semicircular dust collection casing 200 so that the capacity of the dust collection part 250 can be increased. In other words, as shown in FIG. 1, the conventional dust separating apparatus 30 has the contaminant receptacle 32 on the bottom portion of the cyclone body 31 so that the contaminant receptacle 32 can not be manufactured over a certain size and the contaminant receptacle 32 has a limited capacity of dust collection. However, according to an embodiment of the present invention, the dust collection casing 110 is semicircular to remove the dead space S (refer to FIG. 2) from the mounting chamber 13 of the cleaner body 10 in which the dust separating apparatus 100 is mounted and to replace the dead space S with the dust collection part 250. Accordingly, the overall size of the vacuum cleaner body 11 is not changed by dust separating apparatus 100 but the capacity of the dust collection part 250 increases.

Referring back to FIG. 3, the cover 260 is detachably engaged with the top portion of the dust collection casing 200. Accordingly, as the dust collection casing 200 is repaired or the contaminant collected in the dust collection part 250 is emptied, it is only required to separate the cover 260. A cylindrical discharge guide pipe 261 protrudes in a certain length from an inner surface of the cover 260. As air removed of contaminant ascends from the cyclone chamber 233, the discharge guide pipe 261 guides the air to the air discharge pipe 235.

The operations of the dust separating apparatus 100 with the above structure according to an embodiment of the present invention will be explained with reference to FIGS. 3 through 7.

As the motor (not shown) of the vacuum cleaner drives, a suction force generates which operates via the dust separating apparatus 100 on the air inlet 205. Air and contaminant are drawn through the suction nozzle 21 (refer to FIG. 1) fluidly communicated with the air inlet 205 into the dust separating apparatus 100. The suction force of the motor simultaneously operates on the mesh filter 221, the primary and the secondary cyclones 230, 240 so that the suction force of the vacuum cleaner can increase.

As contaminant-laden air flows in the air inlet 205, the contaminant-laden air flows via the guide air path 220 to the mesh filter 221 on which the strongest suction force operates. The contaminant flowed to the mesh filter 221 is filtered by the mesh filter 221 and the air flows out to the motor driving chamber 12 (refer to FIG. 1) via the air discharge opening 206.

It should be recognized that the outlet port 15 of the prior art vacuum cleaner 10 is shown on a side portion of mounting chamber 13. Since dust separating apparatus 100 includes the air discharge opening 206 and the cyclone outlet 236 formed on the bottom surface 208, the outlet port 15 would be located on a bottom portion of mounting chamber 13 so that the air discharge opening 206 and the cyclone outlet 236 are in fluid communication with the outlet port 15.

As the mesh filter 221 is blocked by contaminant in process of cleaning, the suction force of the motor operates on the primary and the secondary cyclones 230, 240. Accordingly, air and contaminant drawn in via the air inlet 205 flow via the cyclone inlet 232 into the primary and the secondary cyclones 230, 240 arranged in parallel. As arrow A of FIG. 7, forming a rotating stream, the air and contaminant flowed in the cyclone inlet 232 ascends in the cyclone chamber 233. At this time, heavier contaminant than air are gathered on an inner wall of the cyclone body 231 by the centrifugal force and flow up by an ascending stream to get out through the dust discharge opening 234 and to collect at the dust collection part 250 as arrow B of FIG. 7.

Figure 7:
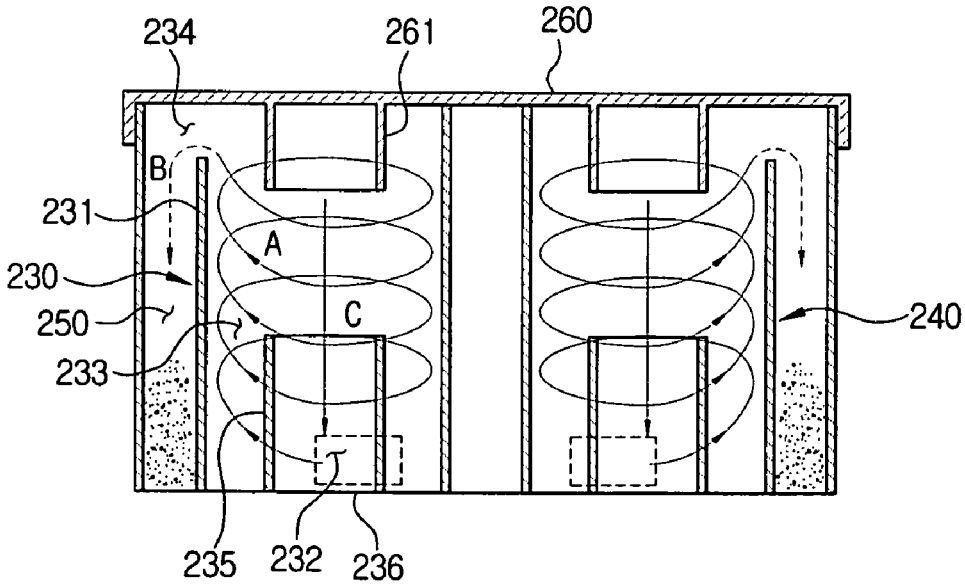
FIG. 7 is a cross-sectional view of the dust separating apparatus taken along on VII-VII line of FIG. 4 in an assembled state.

The air removed of the contaminant collides with the cover 260 to re-descend and is guided by the discharge guide pipe 261 to discharge via the air discharge pipe 235 and the cyclone outlet 236 to the motor driving chamber as arrow C of FIG. 7.

As described above, according to the dust separating apparatus consistent with embodiments of the present invention, the suction force simultaneously operates on the mesh filter in the guide air path and a plurality of cyclones so that the suction force can increase. Additionally, the mesh filter and the plurality of cyclones, which are in parallel arranged, sequentially operate to filter contaminant so that the pressure loss can decrease and the dust collection efficiency can increase, compared to the conventional dust separating apparatus with two cyclones arranged in line.

Finally, the plurality of cyclones are arranged in the semicircular dust collection casing corresponding to the mounting chamber and the dust collection part is formed in the rest space except for the cyclones of the dust collection casing so that the dead space, formed in the conventional vacuum cleaner body, can be removed and replaced with the dust collection part. Therefore, the capacity of the dust collection part increases.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. A dust separating apparatus detachably engaged with a mounting chamber of a vacuum cleaner body to separate and collect a contaminant from an air drawn in from a cleaning surface by a suction force of a motor, comprising:

a dust collection casing with an air inlet at a lower portion;

a mesh filter formed on a bottom surface of the dust collection casing to filter the contaminant from the drawn-in air;

a plurality of cyclones formed in parallel in the dust collection casing to secondly filter the contaminant in the drawn-in air; and a dust collection part formed at one side of the plurality of cyclones to collect the contaminant separated from the drawn-in air, wherein, if the mesh filter is unclogged, the drawn-in air comprises a first portion that is discharged via the mesh filter and a remaining portion that is discharged via the plurality of cyclones, and wherein, if the mesh filter is clogged, all the drawn-in air is discharged via the plurality of cyclones.

2. The apparatus according to claim 1, wherein the plurality of cyclones comprise a primary cyclone and a secondary cyclone, and wherein the mesh filter is formed between the primary and the secondary cyclones.

3. The apparatus according to claim 1, wherein the dust collection casing is substantially semicircular including a linear part and an arc part that correspond to a shape of the mounting chamber.

4. The apparatus according to claim 3, wherein each of the primary and the secondary cyclones comprises a cyclone body, the cyclone body comprising:

a cyclone inlet formed at a lower portion of the cyclone body to correspond to the air inlet;

a cyclone chamber centrifugally separating the contaminant from the drawn-in air; and a dust discharge opening formed at an upper portion of the cyclone body to discharge contaminant from the air, and a cyclone outlet formed on a bottom surface of the cyclone body, wherein a part of each of the primary and the secondary cyclone bodies is formed by the arc part of the dust collection casing.

5. The apparatus according to claim 4, wherein the dust collection part is substantially surrounded by the linear part of the dust collection part and the primary and the secondary cyclone bodies.

6. The apparatus according to claim 4, further comprising a cover detachably engaged with a top portion of the dust collection casing, and the cover comprises a discharge guide pipe guiding the air to the cyclone outlet as the air ascends to separate from the contaminant in the cyclone chamber.

7. A dust separating apparatus detachably engaged with a mounting chamber of a vacuum cleaner body to separate and collect a contaminant from an air drawn in from a cleaning surface by a suction force of a motor, comprising:

a dust collection casing with an air inlet at a lower portion and being substantially semicircular to correspond to a shape of the mounting chamber;

a guide air path guiding the drawn-in air and contaminant to directly discharge to the motor, the guide air path having a mesh filter filtering the contaminant from a first portion of the drawn-in air when the mesh filter is unclogged;

a primary cyclone and a secondary cyclone formed in parallel with one another in the dust collection casing, the primary and secondary cyclones filtering the contaminant from a second portion of the drawn-in air when the mesh filter is unclogged but filtering the contaminant from all of the drawn-in air when the mesh filter is clogged, and discharging the drawn-in air removed of the contaminant to the motor;

a dust collection part formed at one side of the primary and the secondary cyclones in the dust collection casing to collect the contaminant separated from the air by the primary and the secondary cyclones; and a cover detachably engaged with a top portion of the dust collection casing and having a discharge guide pipe.

8. The apparatus according to claim 7, wherein the guide air path is formed between the primary and the secondary cyclones.

9. The apparatus according to claim 8, wherein each of the primary and the secondary cyclones comprises a cyclone body, the cyclone body comprising:

a cyclone inlet formed at a lower portion of the cyclone body to correspond to the air inlet;

a cyclone chamber centrifugally separating the contaminant from the air drawn in via the cyclone inlet;

a dust discharge opening formed on an upper portion of the cyclone body to discharge the contaminant separated from the air; and an air discharge pipe protruding from a bottom surface of the cyclone body and including a cyclone outlet discharging the air removed of the contaminant to the motor.

* * * * *